US007500627B2

(12) United States Patent
Park et al.

(10) Patent No.: US 7,500,627 B2
(45) Date of Patent: Mar. 10, 2009

(54) SHREDDER

(75) Inventors: Han Sung Park, Seoul (KR); Jong Gyu Kim, Gyeonggi-do (KR)

(73) Assignee: Royal Sovereign Inc., Seoul (KR)

( * ) Notice: Subject to any disclaimer, the term of this patent is extended or adjusted under 35 U.S.C. 154(b) by 421 days.

(21) Appl. No.: 11/357,664

(22) Filed: Feb. 17, 2006

(65) Prior Publication Data

US 2006/0179987 A1 Aug. 17, 2006

(30) Foreign Application Priority Data

Feb. 17, 2005 (KR) ..... 10-2005-0013275

(51) Int. Cl.
*B02C 18/22* (2006.01)

(52) U.S. Cl. ..... 241/36; 241/225; 241/236

(58) Field of Classification Search ..... 241/236, 241/225, 34, 36

See application file for complete search history.

(56) References Cited

U.S. PATENT DOCUMENTS 4,893,759 A * 1/1990 Mizobata ..... 241/100
5,001,520 A * 3/1991 Kawano et al. ..... 399/372
5,188,301 A * 2/1993 Hasegawa ..... 241/33
6,550,701 B1 * 4/2003 Chang ..... 241/36
2006/0128543 A1 * 6/2006 Sekine et al. ..... 493/355

FOREIGN PATENT DOCUMENTS

DE 3614028 * 10/1987
KR 2000-325151 5/2002

* cited by examiner

*Primary Examiner*—Mark Rosenbaum
(74) *Attorney, Agent, or Firm*—Saliwanchik, Lloyd & Saliwanchik

(57) ABSTRACT

A shredder is provided for allowing a user to select a desired feed type from a manual paper feeding type and an automatic paper feeding type. An embodiment of the shredder includes a driving motor; a connection part transmitting a dynamic force of the driving motor; a cutter shredding paper sheets inputted by a dynamic force transmitted from the connection part; a manual paper feeding part manually supplying paper sheets to the cutter; and an automatic paper feeding part automatically supplying paper sheets to the cutter by the dynamic force provided from the connection part.

19 Claims, 6 Drawing Sheets

SHREDDER

BACKGROUND OF THE INVENTION

1. Field of the Invention

The present invention relates to a shredder, and particularly, to a shredder capable of improving user's convenience by allowing paper sheets to be selectively supplied automatically and manually.

2. Description of the Related Art

A shredder is an office device, which is increasingly used. The shredder is an electronic device for cutting documents into small pieces in order to prevent the leakage of expired documents.

The shredder may be divided into a manual paper feeding type and an automatic paper feeding type. Each type of shredder has its own advantages and disadvantages. The automatic feed type shredder is used to shred a large amount of paper sheets, and the manual feed type shredder is used to shred a small amount of paper sheets.

The disadvantages of those types of shredders are as follows. First, as for the manual feed type shredder, an operator should stay close by during shredding operation on paper sheets and pay attention in order to supply the proper number of paper sheets or less. Second, if a large number of paper sheets are fed at the same time, a driving motor may be stopped, or the paper sheets may not be completely shredded. If an overload frequently occurs, a lifespan of a device is reduced.

Third, as for the automatic feed type shredder, because paper sheets are supplied sheet by sheet, shredding speed deteriorates as compared to the manual feed type shredder.

SUMMARY OF THE INVENTION

Accordingly, the present invention is directed to a shredder that substantially obviates one or more problems due to limitations and disadvantages of the related art.

Advantageously, the present invention provides an embodiment for a shredder capable of selectively adopting document feeding types according to a users desire.

The present invention provides a shredder capable of reducing an operation time by allowing a large number of paper sheets to be cut into small pieces at the same time.

Moreover, another embodiment of the shredder of the present invention is to provide a shredder that is capable of reducing an overload of an internal element thereof and preventing abnormal operation and noise due to an overload by maintaining a supply of the proper number of paper sheets.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a specific embodiment of a shredder including: a driving motor; a connection part transmitting a dynamic force of the driving motor; a cutter shredding paper sheets inputted by a dynamic force transmitted from the connection part; a manual paper feeding part manually supplying paper sheets to the cutter; and an automatic paper feeding part automatically supplying paper sheets to the cutter by a dynamic force provided from the connection part.

In another aspect of the present invention, there is provided a specific embodiment of a shredder including: a driving motor; a connection part transmitting a dynamic force of the driving motor; a cutter shredding paper sheets inputted by a dynamic force transmitted from the connection part; a paper feeding tray on which a plurality of paper sheets are placed; a pressing part pushing up paper sheets on the tray; and a supply protrusion rotated by a dynamic force provided by the connection part and conveying a plurality of paper sheets at the opposite side to the pressing part.

In a further another aspect of the present invention, there is provided a specific embodiment of a shredder including: a driving motor; a connection part transmitting a dynamic force of the driving motor; a cutter shredding paper sheets inputted by a dynamic force transmitted from the connection part; a manual paper feeding part manually supplying paper sheets to the cutter; an automatic paper feeding part having an automatic paper feeding roller rotated by a dynamic force supplied from the connection part; and a supply protrusion formed at an outer circumference of the automatic paper feeding roller and conveying a plurality of paper sheets.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

First Embodiment

Figure 1:
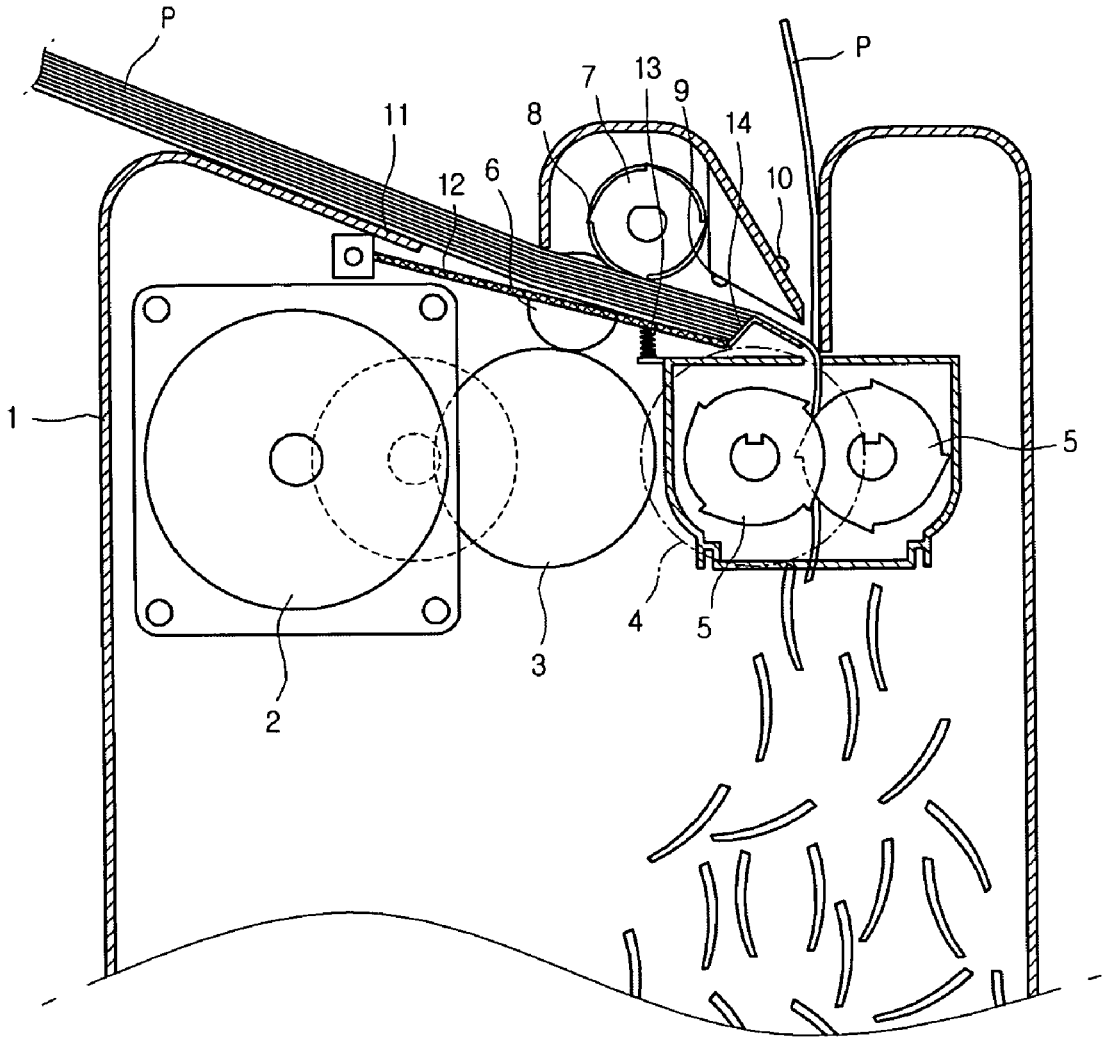
FIG. 1 is a cross-sectional view of a shredder according to a first embodiment of the present invention.

FIG. 1 is a cross-sectional view of a shredder according to a first embodiment of the present invention.

Referring to the embodiment illustrated in FIG. 1, the shredder according to the present invention can be characterized in that paper feeding can be controlled both manually and automatically.

Particularly, the shredder according to the present invention includes a case 1 forming an exterior of the shredder, a driving motor 2 formed inside the case 1 and providing a driving force, a connection part 3 transmitting a driving force of the driving motor 2 to a proper place, a cutter side connection gear 4 connected to the connection part 3 and transmitting a driving force to a cutter 5, and a feed side connection gear 6 connected to the connection part 3 and transmitting a driving force to an automatic paper feeding roller 7.

Particularly, an automatic feed side includes a paper feeding tray 11 on which a plurality of paper sheets are placed, a pressing part 12 placed under the paper feeding tray 11 and pushing up the paper sheets placed on the paper feeding tray 11, a pressing spring 13 providing elasticity to the pressing part 12 and pushing up the pressing part 12, and an automatic paper feeding roller 7 provided on the paper feeding tray 11 and pressing down the paper sheets (P).

An automatic-feeding sensor 9 for sensing whether or not paper sheets are placed on the paper feeding tray 11 is formed at a front end of the paper feeding tray 11. The automatic feeding sensor 9 may be a contact sensor for sensing contact with the paper or may be an optical sensor for sensing a paper feed state as the paper blocks light transmittance. Also, in order to sense manually fed paper, a manual-feeding sensor 11 is formed at a front end of an input portion of a manual feed part, thereby sensing manually supplied paper. When the feed of paper sheets to be shredded is sensed by the automatic-feeding sensor 9 and the manual-feeding sensor 10, the driving motor 2 is operated to start the operation of the cutter 5 and the automatic paper feeding roller 7.

A plurality of automatic paper feeding rollers 7 are fixed to one roller shaft (refer to 15 of FIG. 2), and a supply protrusion 8 is formed at an outer circumference of at least one portion of each automatic paper feeding roller 7, thereby conveying a certain number of paper sheets at a time by catching them.

Although a proper number of gears are used for the connection part 3 in the drawing, the driving force transmitting method is not limited thereto but other connection units like a belt or the like may be used without affecting the embodiment of the present invention.

Referring to the aforementioned construction, the operation and effect of the shredder according to the present invention will now be described.

First, automatic shredding of paper sheets in an automatic paper feeding type will now be described. When paper sheets are placed on a paper feeding tray 11, the automatic-feeding sensor 9 senses the supply of the paper sheets, and thusly, the operation of the driving motor 2 is started.

When the paper sheets are placed on the paper feeding tray 11, a force that pushes up the pressing part 12 about a hinge point of a left side is generated by the pressing spring 13, thereby allowing the paper sheets to come in contact with the automatic paper feeding roller 7.

When the paper sheets are pushed up by the pressing part 12, the upper most sheet of the stacked paper sheets comes in contact with the automatic paper feeding roller 7, and a rotary force of the driving motor 2 is transmitted to the automatic paper feeding roller 7 through the connection part 3 and the feed side connection gear 6, thereby rotating the automatic paper feeding roller 7. Also, supply protrusions 8 are formed on an outer circumference of the automatic paper feeding roller 7 at regular intervals, so that the automatic paper feeding roller 7 can convey more than a certain number of paper sheets at a time by catching them.

Here, providing a pointed tip at the end of each supply protrusion 8 may allow conveyance of a plurality of paper sheets. Also, the paper sheets cannot be moved downward without an external force because they are caught by a stepped protrusion 14, and only a certain number of paper sheets caught by the supply protrusion 8 can pass over the stepped protrusion 14 and conveyed by being forcibly pushed. Needless to say, because the pressing part 12 keeps moving the paper sheets upwardly, the paper sheets left without being conveyed of the stacked paper sheets may be continuously supplied in certain amount even after more than a certain number of paper sheets are conveyed.

Also, the paper sheets having passed over the stepped protrusion 14 is provided to the cutter 5 to be shredded into small pieces.

A manual document shredding process will now be described. When paper sheets are supplied to a manual feed part, paper sheets are sensed by the manual-feeding sensor 10, thereby starting driving of the driving motor 2. Then, a rotary force is transmitted to the cutter 5 through the driving motor 2, the connection part 3 and the cutter side connection gear 4. The cutter 5 is provided as a pair, so that the paper sheets to be shred can be caught between the cutters 5. The cutter 5 may have a circular section and may be provided with a plurality of blades.

Once the paper sheets are caught in a gap between the cutters 5, the cutters 5 are rotated relatively fast. Therefore, the paper sheets can be speedily shredded into small pieces without the automatic paper feeding roller 7 pushing it. To this end, it is apparent to those skilled in the art that changing a connection ratio of the gear may allow the cutters 5 to be rotated at a speed slightly faster than the automatic paper feeding roller 7.

Also, if an overload occurs at the motor due to an excessive number of paper sheets caught between the cutters 5, the undesired catching of the paper sheets can be checked by using a method such as checking speed degradation of a motor and/or a power consumption increase. The paper sheets overloaded within the cutter can be removed as the driving motor 2 is temporarily stopped and then makes a reverse rotation a certain number times. Thereafter, the driving motor 2 is stopped. This facilitates extraction of over-provided paper sheets, prevents damage to the shredder due to an overload of the motor and contributes to the elongation of a life span of a product.

Second Embodiment

The second embodiment of the present invention is identical to the first embodiment except for the shape of the automatic paper feeding roller. Therefore, the same reference numbers will be used throughout the drawing to refer to the same or like parts as those in the first embodiment.

Figure 2:
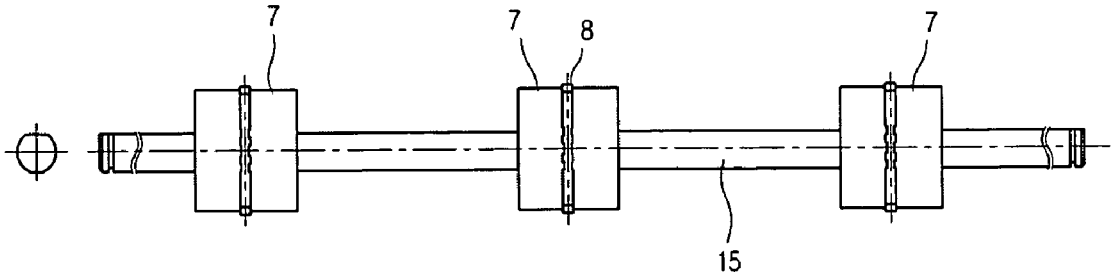
FIG. 2 is a front view of an automatic paper feeding roller according to a second embodiment of the present invention.

FIG. 2 is a front view of an automatic paper feeding roller according to the second embodiment of the present invention.

Referring to FIG. 2, in the present embodiment, provided are a plurality of automatic paper feeding rollers 7 for supplying paper sheets by certain amounts, a supply protrusion 8 formed near a central portion of each automatic paper feeding roller 7, and a roller shaft 15 for rotating the automatic paper feeding roller 7 at a constant speed. Although not shown, it is apparent to those skilled in the art that a gear engaged with the input side connection gear 6 is fixed to at least one side of the roller shaft 15.

In this embodiment of the present invention, the plurality of automatic paper feeding rollers 7 are formed, so that paper sheets can be smoothly fed in an advancing direction without being crumpled.

Third Embodiment

The third embodiment is identical to the first embodiment except for the automatic paper feeding roller for automatically supplying paper sheets. Therefore, the same reference numbers will be used throughout the drawing to refer to the same or like parts as those in the first embodiment.

Figure 3:
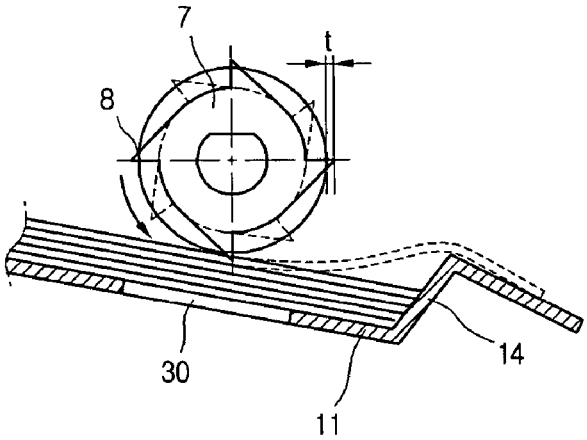
FIG. 3 is a cross-sectional view of an automatic paper feeding roller according to a third embodiment of the present invention.

FIG. 3 is a cross-sectional view of an automatic paper feeding roller according to the third embodiment of the present invention.

Referring to FIG. 3, the automatic paper feeding roller 7 is formed as a circular shape, and a plurality of supply protrusions 8 are formed around an outer circumference of the automatic paper feeding roller 7. The supply protrusion protrudes outward to a certain length. Paper sheets (P) placed on the paper feeding tray 11 are simultaneously conveyed in plurality only when caught by the supply protrusion 8 and pass over the stepped protrusion 14. When the paper sheets caught by the supply protrusion 8 are conveyed, they are pushed in contact with an outer circumferential surface of the automatic paper feeding roller 7. Accordingly, a plurality of paper sheets can be accurately conveyed. When the paper sheets cannot be conveyed by the automatic paper feeding roller 7, they are caught by another supply protrusion and then conveyed. For this reason, conveyance of paper sheets that are being conveyed is not stopped.

Because a plurality of paper sheets can be conveyed by the aforementioned structure, the number of paper sheets being shredded at the same time may increase to about five sheets not a single sheet. In other specific embodiments, the number of paper sheets being shredded at the same time may be about four sheets, about three sheets, or about two sheets.

In order to convey a plurality of paper sheets at the same time, the supply protrusion protrude outward from the automatic paper feeding roller 7 to a certain length (t). A large number of paper sheets can be simultaneously conveyed when the certain length (t) is long. To this end, the capacity of the motor may be larger and the amount of power supply may be greater. This is similar for other embodiments.

A supply protrusion receiving groove 30 is formed at a predetermined position of the paper feeding tray 11. When no paper sheet exists on the paper feeding tray 11, the supply protrusion 8 moves down and is received in the supply protrusion receiving groove 30 so as to be supported by the paper feeding tray 11. Accordingly, the supply protrusion receiving groove 30 serves to prevent scratches on the paper feeding tray 11 due to the supply protrusion 8 when the automatic paper feeding roller 7 rotates.

To this end, the supply protrusion receiving groove 30 may be formed long in the paper feeding tray 11 in a direction that the automatic paper feeding roller 7 rotates. When no paper sheet is provided or only a small number of paper sheets are placed on the paper feeding tray 11, the supply protrusion 8 is received in the supply protrusion receiving groove 30, thereby preventing contact between the supply protrusion 8 and the paper feeding tray 11. Accordingly, scratches or deformation of the paper feeding tray 11 can be prevented, and the operation of the automatic paper feeding roller 7 is not interrupted as the automatic paper feeding roller 7 is supported on the paper feeding tray 11.

Fourth Embodiment

The fourth embodiment of the present invention is identical to the first embodiment except for construction of the automatic paper feeding roller. Therefore, the same reference numbers will be used throughout the drawing to refer to the same or like parts as those in the first embodiment.

Figure 4:
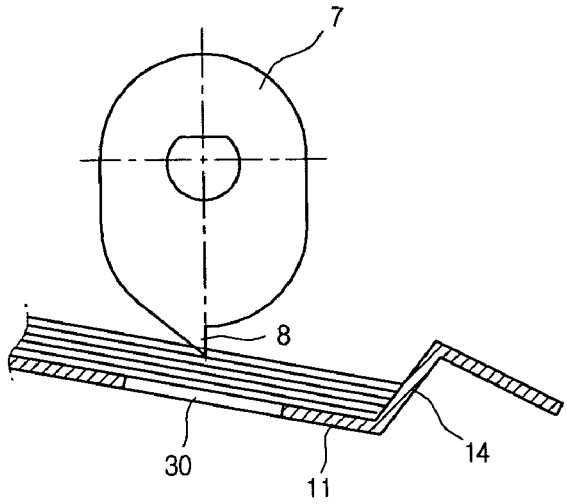
FIG. 4 is a cross-sectional view of an automatic paper feeding roller according to a fourth embodiment of the present invention.

FIG. 4 is a cross-sectional view of an automatic paper feeding roller according to the fourth embodiment of the present invention.

Referring to FIG. 4, the automatic paper feeding roller 7 is eccentrically formed as a rough oval shape one side of which is elongated. A supply protrusion 8 having a pointed tip protrudes from one side of a protruding long-axis portion of the oval shape. Needless to say, the supply protrusion 8 protrudes to a certain length from an outer circumferential surface of the automatic paper feeding roller 7, and its end forms a pointed tip, so that paper sheets can be lifted up by being caught thereby and thusly can be conveyed over the stepped portion 14.

Also, a plurality of paper sheets caught by the supply protrusion 8 are pushed by an outer circumferential surface of the automatic paper feeding roller 7 and are conveyed in a conveyance direction.

Fifth Embodiment

The fifth embodiment of the present invention is identical to the first embodiment except for construction of the automatic paper feeding roller. Therefore, the same reference numbers will be used throughout the drawings to refer to the same or like parts as those in the first embodiment.

Figure 5:
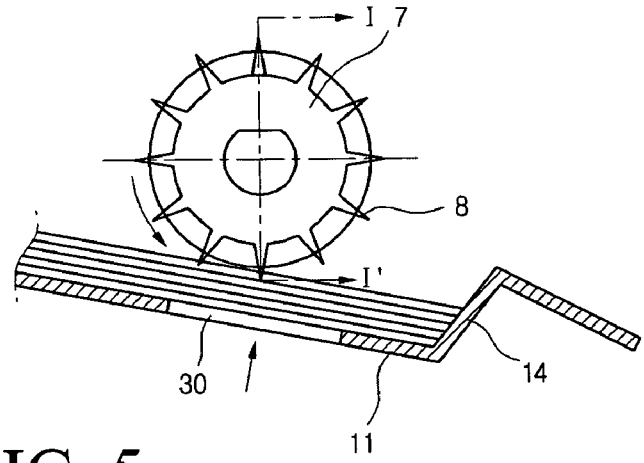
FIG. 5 is a cross-sectional view of an automatic paper feeding roller according to a fifth embodiment of the present invention.
Figure 6:
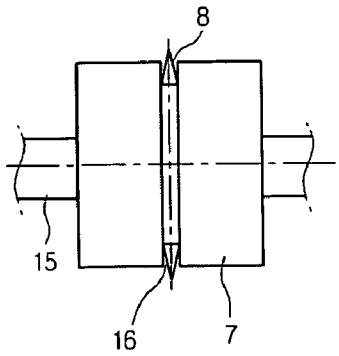
FIG. 6 is a cross-sectional view taken along line I-I' of FIG. 5.

FIG. 5 is a cross-sectional view of an automatic paper feeding roller according to the fifth embodiment, and FIG. 6 is a cross-sectional view taken along line I-I' of FIG. 5.

Referring to FIGS. 5 and 6, in the fifth embodiment according to the present invention, the automatic paper feeding roller 7 has a circular shape, a groove 16 is formed with a certain width around an outer circumference of the automatic paper feeding roller, and a sharp supply protrusion 8 is protrudingly formed inside the groove 16. Also, because a plurality of supply protrusion, for example, twelve supply protrusions, are formed, the paper sheets can be perfectly conveyed and guided by the supply protrusions.

Sixth Embodiment

The sixth embodiment of the present invention is identical to the first embodiment except for the construction of the automatic paper feeding roller. Therefore, the same reference numbers will be used throughout the drawings to refer to the same or like parts as those in the first embodiment.

Figure 7:
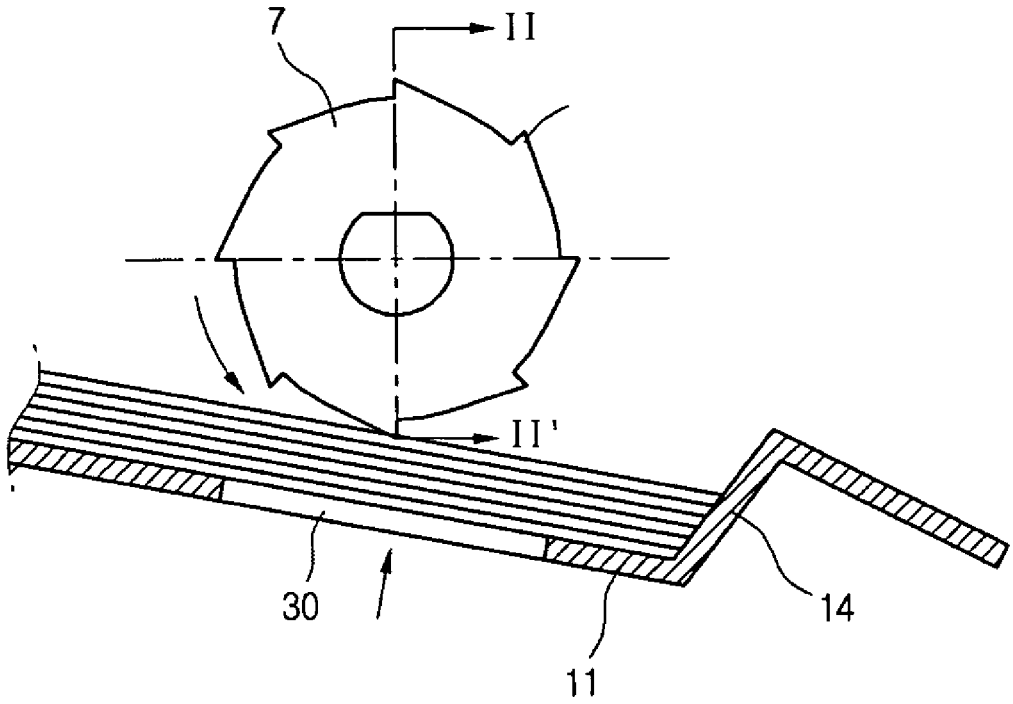
FIG. 7 is a cross-sectional view of an automatic paper feeding roller according to a sixth embodiment of the present invention.
Figure 8:
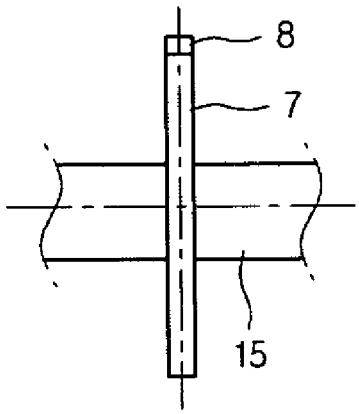
FIG. 8 is a cross-sectional view taken along line II-II' of FIG. 7.

FIG. 7 is a cross-sectional view of an automatic paper feeding roller according to the sixth embodiment of the present invention, and FIG. 8 is a cross-sectional view taken along line II-II'.

Referring to FIGS. 7 and 8, the automatic paper feeding roller 7 and the supply protrusions 8 are integrally formed, and the supply protrusions 8 protrude from an outer circumference of the automatic paper feeding roller 7 at regular intervals.

With such a shape, the conveyance of paper sheets can be smoothly performed without interruption.

The supply protrusion 8 according to the present embodiment is sharply inclined in one direction that paper sheets are supposed to be conveyed, so that a plurality of paper sheets can be conveyed more reliably.

Seventh Embodiment

The seventh embodiment of the present invention is identical to the first embodiment except for the construction of the automatic paper feeding roller. Therefore, the same reference numbers will be used throughout the drawings to refer to the same or like parts as those in the first embodiment.

Figure 9:
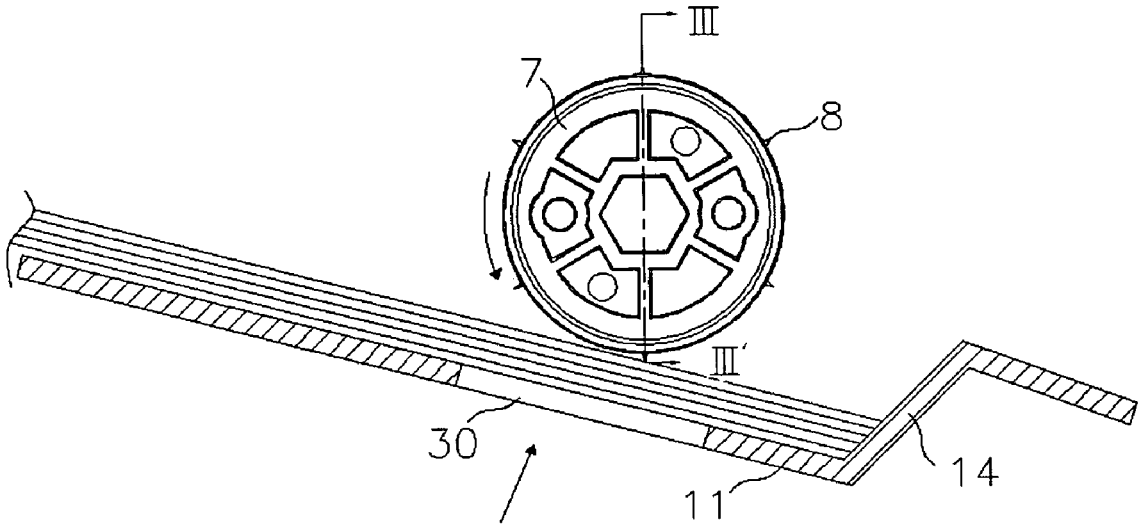
FIG. 9 is a cross-sectional view of an automatic paper feeding roller according to a seventh embodiment of the present invention.
Figure 10:
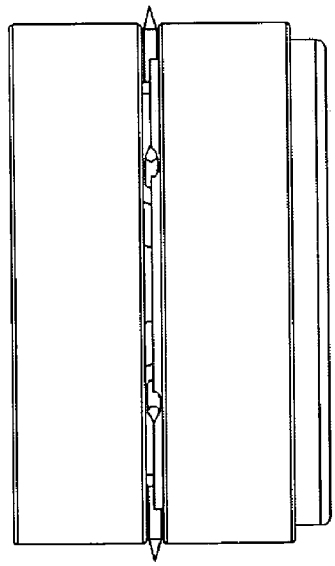
FIG. 10 is a cross-sectional view taken along line III-III' of FIG. 9.

FIG. 9 is a cross-sectional view of an automatic paper feeding roller according to the seventh embodiment of the present invention, and FIG. 10 is a cross-sectional view taken along line III-III' of FIG. 9.

Referring to FIGS. 9 and 10, the automatic paper feeding roller 7 and the supply protrusions 8 are integrally formed, and the supply protrusions 8 protrudes from an outer circumference of the automatic paper feeding roller 7 at regular intervals.

With such a shape, the conveyance of paper sheets can be smoothly performed without being interrupted.

Because the supply protrusion 8 according to the present embodiment is formed by a special element having a sharp nail shape only in one direction that the paper sheets are supposed to be conveyed, a plurality of paper sheets can be conveyed more reliably.

Eighth Embodiment

The eighth embodiment of the present invention is the same as the first embodiment in that paper sheets to be shredded can be automatically supplied by a single driving motor and also be supplied manually. However, the present embodiment is different from the first embodiment in that different cutters are provided for different paper feed types.

Figure 11:
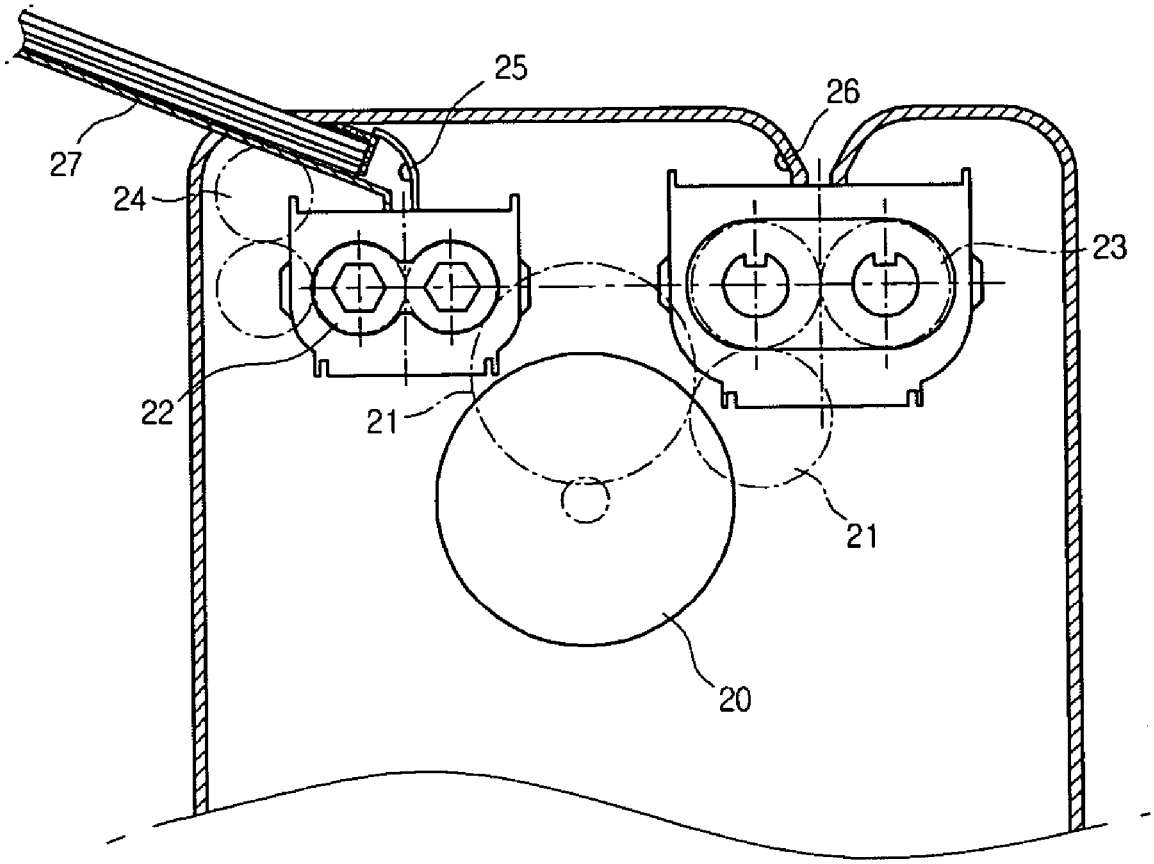
FIG. 11 is a cross-sectional view of a shredder according to an eighth embodiment of the present invention.

FIG. 11 is a cross-sectional view of a shredder according to the eighth embodiment of the present invention.

Referring to FIG. 11, the shredder according to the present embodiment includes a driving motor 20, a connection part 21 transmitting a driving force of the driving motor 20, an automatic-feeding cutter 2 and a manual-feeding cutter 23 shredding paper sheets upon receiving a driving force from the connection part 21, and an automatic paper feeding roller 24 rotated upon receiving a driving force transmitted to the automatic-feeding cutter 22.

Also, provided is a paper feeding tray 27 on which paper is placed in a state that the automatic paper feeding roller 24 is provided at its underside.

Also, an automatic-feeding sensor 25 is formed for sensing placement of paper sheets to be shredded at an automatic shredding part, and a manual-feeding sensor 26 is formed for sensing placement of paper sheets to be manually shredded.

Although the connection part 21 is illustrated as a gear, another connection unit such as a belt or the like can be used according to real usage.

The operation of the paper shredder will now be described with reference to the aforementioned construction. First, when paper sheets are placed on the paper feeding tray 27, the automatic-feeding sensor 25 senses the paper sheets and thus the driving motor 20 is rotated.

The rotation of the driving motor 20 is transmitted through the connection part 21 to the automatic feeding cutter 22 and the automatic feeding roller 24, so that paper sheets placed on the paper feeding tray 27 are supplied to be shredded by proper amounts.

Here, a plurality of supply protrusions are formed around an outer circumference of the automatic feeding roller 24 as in the aforementioned embodiments, so that a plurality of paper sheets can be supplied at a time.

When paper sheets to be shredded are provided to a manual shredding part, the manual feeding sensor 26 sense paper sheets and thus the driving motor 20 is rotated. A rotary force of the driving motor 20 is transmitted to the manual feeding cutter 23 by the connection part 21, so that the manually provided paper sheets can be shredded.

The present embodiment is advantageous in that the paper sheets can be simultaneously shredded manually and automatically. However, because a load of the driving motor 20 should be large in order to perform manual feeding and automatic feeding simultaneously, a driving motor with a relatively large capacity may be used.

According to the present invention, a user may use a shredder upon selecting a desired feeding method, thereby improving user's convenience.

Also, a time for operation is advantageously reduced because a plurality of paper sheets are shredded at a time.

In addition, an overload of an internal element of the shredder in operation can be reduced, and abnormal operation and noises due to the overload can be prevented.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A shredder comprising:

a driving motor;

a connection part transmitting a dynamic force of the driving motor;

a cutter shredding paper sheets inputted by a dynamic force transmitted from the connection part;

a manual paper feeding part manually supplying paper sheets to the cutter; and an automatic paper feeding part automatically supplying paper sheets to the cutter by a dynamic force provided from the connection part;

wherein the automatic paper feeding part comprises a paper feeding tray, a roller, and a supply protrusion protruding from an outer circumference of the roller; and wherein a receiving groove in which the supply protrusion is inserted is formed at the paper feeding tray.

2. The shredder according to claim 1, wherein the cutter and the automatic paper feeding part are operated by a single driving motor.

3. The shredder according to claim 1, wherein the cutter is a single cutter and shreds paper sheets provided from the automatic paper feeding part and the manual paper feeding part.

4. The shredder according to claim 1, wherein the cutter is individually provided to shred paper sheets being supplied from the automatic paper feeding part and the manual feeding part.

5. The shredder according to claim 1, wherein the supply protrusion protrudes from the outer circumference of the roller such that a plurality of paper sheets are conveyed at a time.

6. The shredder according to claim 1, wherein the automatic paper feeding part further comprises a pressing part pushing up paper sheets.

7. The shredder according to claim 1, wherein the driving motor is operated by a sensor provided at an entrance of the paper feeding parts.

8. A shredder comprising:

a driving motor;

a connection part transmitting a dynamic force of the driving motor;

a cutter shredding paper sheets inputted by a dynamic force transmitted from the connection part;

a paper feeding tray on which a plurality of paper sheets are placed;

a pressing part pushing up paper sheets on the tray; and a supply protrusion rotated by a dynamic force provided by the connection part and conveying a plurality of paper sheets at the opposite side to the pressing part;

wherein a receiving groove in which the supply protrusion is inserted is formed at the paper feeding tray.

9. The shredder according to claim 8, wherein an end of the supply protrusion is protrudingly formed at an outer circumference of a roller.

10. The shredder according to claim 9, wherein the roller is eccentrically formed.

11. The shredder according to claim 9, wherein the roller is provided in plurality, and the supply protrusion is provided in plurality around an outer circumference of at least one of the plurality of rollers at regular intervals.

12. The shredder according to claim 8, wherein an end of the supply protrusion is a pointed tip.

13. The shredder according to claim 8, wherein a plurality of supply protrusions are formed.

14. The shredder according to claim 8, wherein a stepped portion is formed at a lower end of the paper feeding tray in order to support paper sheets.

15. A shredder comprising:

a driving motor;

a connection part transmitting a dynamic force of the driving motor;

a cutter shredding paper sheets inputted by a dynamic force transmitted from the connection part;

a manual paper feeding part manually supplying paper sheets to the cutter;

an automatic paper feeding part having an automatic paper feeding roller rotated by a dynamic force supplied from the connection part, wherein the automatic paper feeding part comprises a paper feeding tray on which a plurality of paper sheets are placed; and a supply protrusion formed at an outer circumference of the automatic paper feeding roller and conveying a plurality of paper sheets;

wherein a receiving groove in which the supply protrusion is inserted is formed at the paper feeding tray.

16. The shredder according to claim 15, wherein the automatic paper feeding part further comprises:

a pressing part pushing up paper sheets on the paper feeding tray.

17. The shredder according to claim 15, wherein the automatic paper feeding rollers are provided in plurality, and the supply protrusion is provided in plurality around an outer circumference of at least one of the plurality of automatic paper feeding rollers at regular intervals.

18. The shredder according to claim 15, wherein an end of the supply protrusion is protrudingly formed at an outer circumference of the automatic paper feeding roller.

19. The shredder according to claim 15, wherein an end of the supply protrusion is a pointed tip.

* * * * *